US011858605B1

(12) United States Patent
Liu et al.

(10) Patent No.: US 11,858,605 B1
(45) Date of Patent: Jan. 2, 2024

(54) HYBRID-POWER-DRIVEN UNDERWATER ROBOT

(71) Applicants: Guangzhou University, Guangzhou (CN); Zhongkai University of Agriculture Engineering, Guangzhou (CN)

(72) Inventors: Airong Liu, Guangzhou (CN); Zhicheng Yang, Guangzhou (CN); Bingcong Chen, Guangzhou (CN); Jiyang Fu, Guangzhou (CN)

(73) Assignees: GUANGZHOU UNIVERSITY, Guangzhou (CN); ZHONGKAI UNIVERSITY OF AGRICULTURE ENGINEERING, Guangzhou (CN)

( * ) Notice: Subject to any disclaimer, the term of this patent is extended or adjusted under 35 U.S.C. 154(b) by 0 days.

(21) Appl. No.: 18/356,014

(22) Filed: Jul. 20, 2023

(30) Foreign Application Priority Data

Jul. 28, 2022 (CN) ..... 202210899541.7

(51) Int. Cl.
*B63G 8/00* (2006.01)

(52) U.S. Cl.
CPC ..... *B63G 8/001* (2013.01); *B63G 2008/007* (2013.01)

(58) Field of Classification Search
CPC ..... B63G 8/001; B63G 8/00; B63G 2008/007
See application file for complete search history.

(56) References Cited

U.S. PATENT DOCUMENTS 3,034,471 A * 5/1962 Aschinger ..... B63G 8/42 114/244
4,010,619 A * 3/1977 Hightower ..... D07B 1/147 174/113 C
5,291,194 A * 3/1994 Ames ..... H04B 13/02 114/328
5,447,115 A * 9/1995 Moody ..... B63G 8/32 114/316
6,036,499 A * 3/2000 Ford ..... H01R 39/10 439/4

* cited by examiner

*Primary Examiner* — Stephen P Avila
(74) *Attorney, Agent, or Firm* — Getech Law LLC; Jun Ye

(57) ABSTRACT

The present invention provides a hybrid-power-driven underwater robot, including a robot body and a releasing and recovering device, wherein a first transmission cavity is formed in the releasing and recovering device, a seawater removing mechanism and an electric take-up reel are arranged inside the first transmission cavity, a cable is arranged on the electric take-up reel, the cable extends out of the first transmission cavity, and the robot body is fixedly connected to one end of the cable; and a tail fin is movably connected to the robot body, an acceleration mechanism is further arranged on the robot body, a second transmission cavity is formed in the robot body, a driving mechanism for driving the tail fin and the acceleration mechanism is arranged inside the second transmission cavity, and the driving mechanism can drive the tail fin separately or drive the acceleration mechanism separately.

8 Claims, 4 Drawing Sheets

HYBRID-POWER-DRIVEN UNDERWATER ROBOT

TECHNICAL FIELD

The present invention relates to the technical field of robots, in particular to a hybrid-power-driven underwater robot.

BACKGROUND

Underwater robots, or remotely-controlled unmanned underwater robots are submerged devices for carrying out underwater manual operations by means of instruments and devices carried thereon. The existing underwater robots are relatively single in advancing mode and cannot select the appropriate advancing manners according to different underwater states; and generally, seawater cannot be removed from cables used for recovering the underwater robots, so that the cables and take-up reels are prone to corrosion by seawater, and the service life is shortened.

SUMMARY

For the above-mentioned technical problems, the present invention aims to provide a hybrid-power-driven underwater robot. In order to solve the above-mentioned technical problems, the present invention is achieved by means of the following technical solution:

the hybrid-power-driven underwater robot, comprising a robot body and a releasing and recovering device, wherein a first transmission cavity is formed in the releasing and recovering device, a seawater removing mechanism and an electric take-up reel are arranged inside the first transmission cavity, a cable is arranged on the electric take-up reel, the cable extends out of the first transmission cavity, and the robot body is fixedly connected to one end of the cable; and a tail fin is movably connected to the robot body, an acceleration mechanism is further arranged on the robot body, a second transmission cavity is formed in the robot body, a driving mechanism for driving the tail fin and the acceleration mechanism is arranged inside the second transmission cavity, and the driving mechanism can drive the tail fin separately or drive the acceleration mechanism separately.

Preferably, the driving mechanism comprises an electromagnetic device, a support plate, a first elastic member, a permanent magnetic plate, an electric motor, a permanent magnetic block, a first bevel gear, a conductor coil, a connecting plate, a rotating rod, a first transmission strip, a second transmission strip and a sliding toothed plate;

the electromagnetic device is inlaid in a bottom wall of the second transmission cavity, the support plate is connected to the bottom wall of the second transmission cavity by means of the first elastic member, the permanent magnetic plate is fixedly connected to a bottom wall of the support plate, the electric motor is fixedly connected to a top wall of the support plate, the permanent magnetic block and the first bevel gear are fixedly connected to a power output shaft of the electric motor, a transmission recess is formed in an upper end of the power output shaft, the conductor coil and the connecting plate are fixedly connected to a rear wall of the second transmission cavity, the conductor coil is electrically connected to the electromagnetic device, the permanent magnetic block is located in the conductor coil, a through hole is formed in the connecting plate, the rotating rod penetrates through the through hole, the rotating rod is rotatably connected to an inner wall of the through hole, a transmission block is fixedly connected to a lower end of the rotating rod, the transmission block is in the shape of a prism, the shape of the transmission recess matches that of the transmission block, the first transmission strip is perpendicularly fixedly connected to an upper end of the rotating rod, the second transmission strip is perpendicularly fixedly connected to a top wall of the first transmission strip, the sliding toothed plate is slidably connected to a top wall of the second transmission cavity, a transmission channel is formed in a bottom wall of the sliding toothed plate, and the second transmission strip is slidably connected to an inner wall of the transmission channel;

the acceleration mechanism comprises a fixing plate, a first rotating wheel, a second bevel gear and two propeller mechanisms, the fixing plate is fixedly connected to the bottom wall of the second transmission cavity, the first rotating wheel is rotatably connected to the fixing plate, and the second bevel gear is fixedly connected to the first rotating wheel;

each of the propeller mechanisms comprises a transmission belt, an extension plate, a second rotating wheel, a rotating shaft, a hub and a paddle, the extension plate is fixedly connected to an outer wall of the robot body, a third transmission cavity is formed in the extension plate, the rotating shaft is rotatably connected to a side wall of the third transmission cavity, one end of the rotating shaft extends out of the extension plate, the second rotating wheel and the hub are fixedly connected to the rotating shaft, the second rotating wheel is connected to the first rotating wheel by means of the transmission belt, and the paddle is fixedly connected to the hub; and the tail fin is rotatably connected to the robot body by means of a U-shaped member, the U-shaped member penetrates through the second transmission cavity, a first spur gear is fixedly connected to the U-shaped member, and the sliding toothed plate is engaged with the first spur gear.

Preferably, the seawater removing mechanism comprises a guide roller, a second elastic extrusion roller, a first elastic extrusion roller, a second spur gear, a third spur gear, fan blades, an electric heating net controller and an electric heating net, the guide roller, the second elastic extrusion roller, the second spur gear and the third spur gear are rotatably connected to a rear wall of the first transmission cavity, the first elastic extrusion roller is fixedly connected to the second spur gear, the fan blades are fixedly connected to the third spur gear, the second spur gear is engaged with the third spur gear, the electric heating net controller is fixedly connected to the rear wall of the first transmission cavity, the electric heating net is fixedly connected to the electric heating net controller, the second elastic extrusion roller and the first elastic extrusion roller clamp the cable, and the cable abuts against the guide roller.

Preferably, the transmission block is in the shape of the prism.

Preferably, the cable is made of a colored material.

Preferably, the first elastic extrusion roller and the second elastic extrusion roller are made of silica gel materials.

Preferably, the first elastic extrusion roller and the second elastic extrusion roller are made of sponge materials.

Preferably, a flow drainage plate is fixedly connected to a bottom wall of the first transmission cavity, and a top wall of the flow drainage plate is in the shape of an inclined plane.

Preferably, the flow drainage plate is made of a stainless steel material.

The present invention has the following beneficial effects:

switching between two kinds of power can be carried out by controlling the rotating speed of the power output shaft of the electric motor, a tail fin swinging mode is adopted at ordinary times, when acceleration is needed in case of an emergency, the power output shaft can rotate in an accelerated manner to switch to an acceleration mode, that is, the two paddles rotate to drive the robot body to advance stably, dual-mode switching can be realized by just one power source, namely, one electric motor, thus the design is ingenious, and the practicability is high;

moisture of the cable is squeezed by means of the second elastic extrusion roller and the first elastic extrusion roller, and meanwhile, the fan blades rotate to blow out hot wind to further remove the seawater for the cable; and the cable in a wet state is prevented from entering the electric take-up reel, so that the cable and the interior of the electric take-up reel are prevented from being corroded by the seawater.

BRIEF DESCRIPTION OF DRAWINGS

The present invention is further illustrated by means of the drawings; however, embodiments in the drawings do not constitute any limitation on the present invention; and those of ordinary skill in the art can obtain other drawings according to the following drawings without involving any inventive effort.

Figure 1:
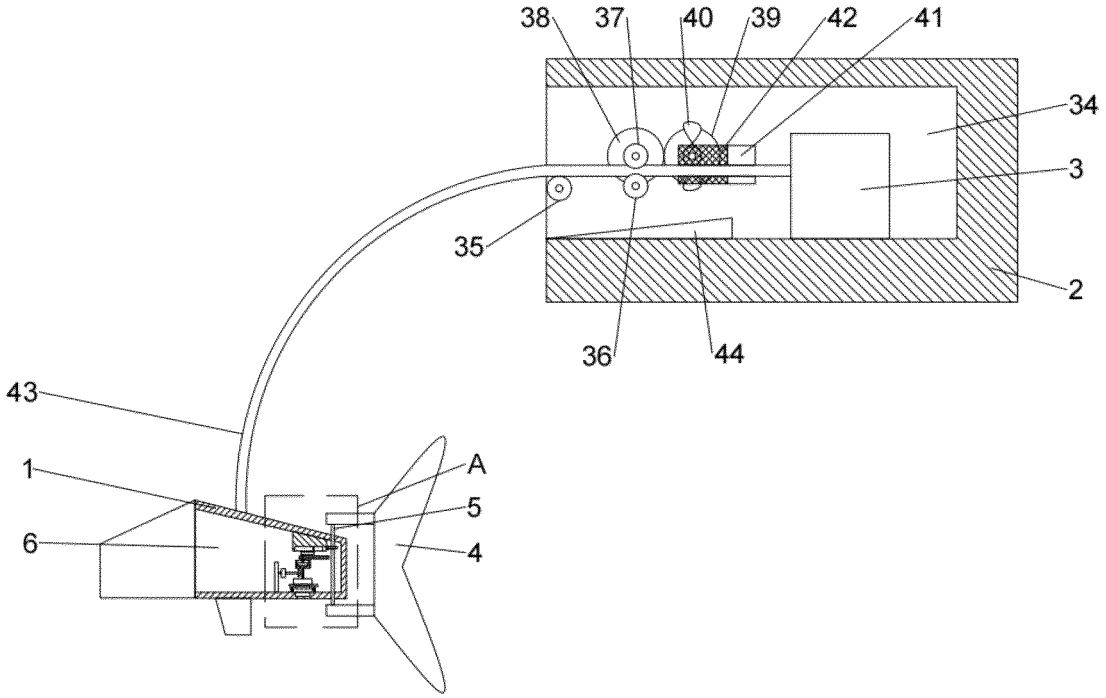
FIG. 1 is a structure diagram of a hybrid-power-driven underwater robot in the present invention.

Reference numerals: robot body 1, releasing and recovering device 2, electric take-up reel 3, tail fin 4, U-shaped member 5, second transmission cavity 6, electromagnetic device 7, support plate 8, first elastic member 9, permanent magnetic plate 10, electric motor 11, power output shaft 111, transmission recess 12, permanent magnetic block 13, first bevel gear 14, fixing plate 15, first rotating wheel 16, second bevel gear 17, conductor coil 18, connecting plate 19, through hole 20, rotating rod 21, transmission block 22, first transmission strip 23, second transmission strip 24, sliding toothed plate 25, transmission channel 26, first spur gear 27, transmission belt 28, extension plate 29, third transmission cavity 30, rotating shaft 31, second rotating wheel 32, hub 33, paddle 331, first transmission cavity 34, guide roller 35, second elastic extrusion roller 36, first elastic extrusion roller 37, second spur gear 38, third spur gear 39, fan blade 40, electric heating net controller 41, electric heating net 42, cable 43, and flow drainage plate 44.

DETAILED DESCRIPTION OF EMBODIMENTS

The technical solutions in embodiments of the present invention will be described clearly and completely below in conjunction with the accompanying drawings in the embodiments of the present invention. Obviously, the described embodiments are only a part of embodiments of the present invention, not all of them. On the basis of the embodiments of the present invention, all other embodiments obtained by those of ordinary skill in the art without involving any inventive effort should fall within the scope of protection of the present invention.

In the description of the present invention, it should be noted that orientation or position relationships indicated by terms such as "vertical", "upper", "lower", "horizontal" and the like are orientation or position relationships based on the accompanying drawings, are only for the purposes of facilitating the description of the present invention and simplifying the description, and do not indicate or imply that the device or element referred to must have the specific orientation or be constructed and operated in the specific orientation. Therefore, they cannot be understood as limitations on the present invention. In addition, the terms "first", "second", "third" and "fourth" are only for the purpose of description, and cannot be understood as indicating or implying the relative importance.

In the description of the present invention, it should also be noted that unless otherwise specified and limited, the terms "arrangement", "mounting", "connecting", and "connection" should be understood in a broad sense, for example, they may be fixed connection, and may also be detachable connection or integrated connection; they may be mechanical connection, and may also be electrical connection; and they may be direct connection, and may also be connection by means of intermediate media or communication of the interiors of two elements. For those of ordinary skill in the art, specific meanings of the above terms in the present invention may be understood according to specific circumstances.

Figure 2:
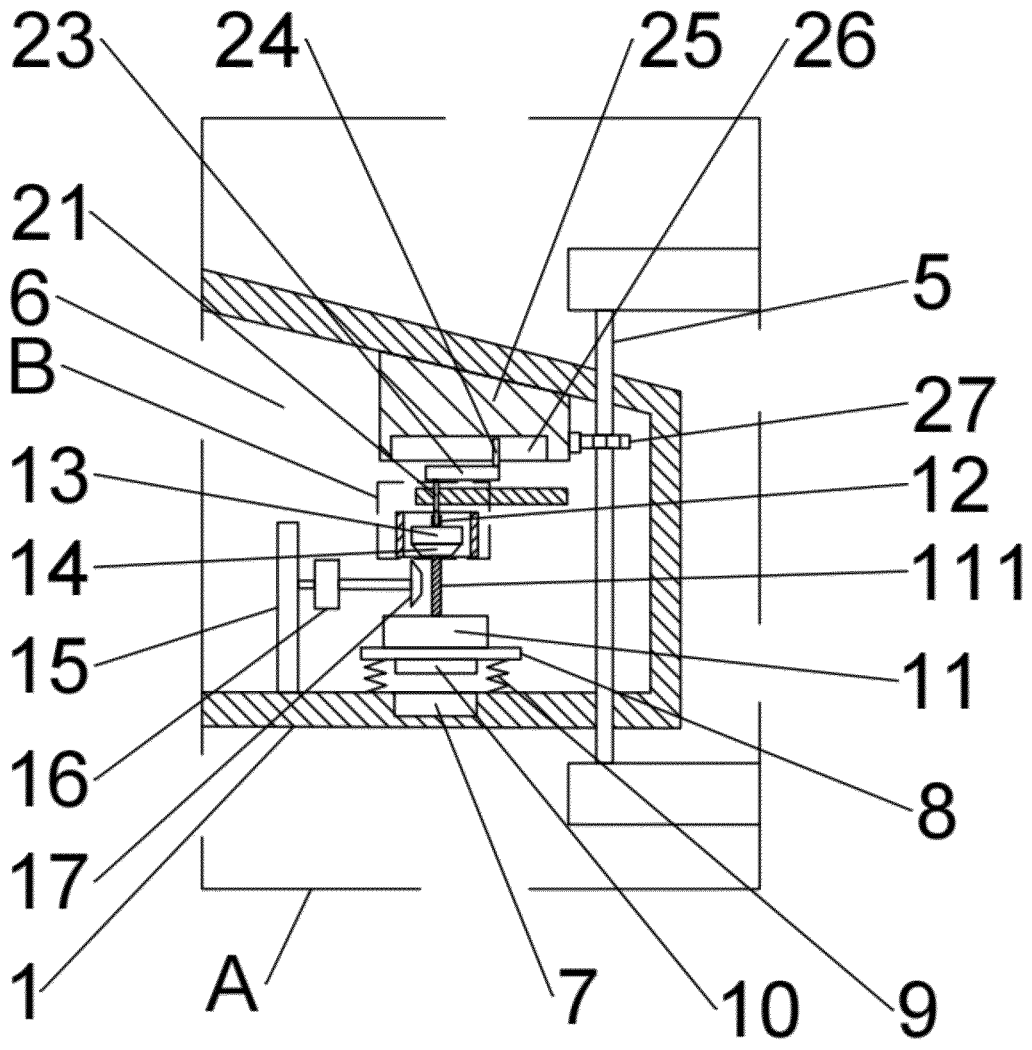
FIG. 2 is an enlarged view at A in FIG. 1 of the present invention.
Figure 3:
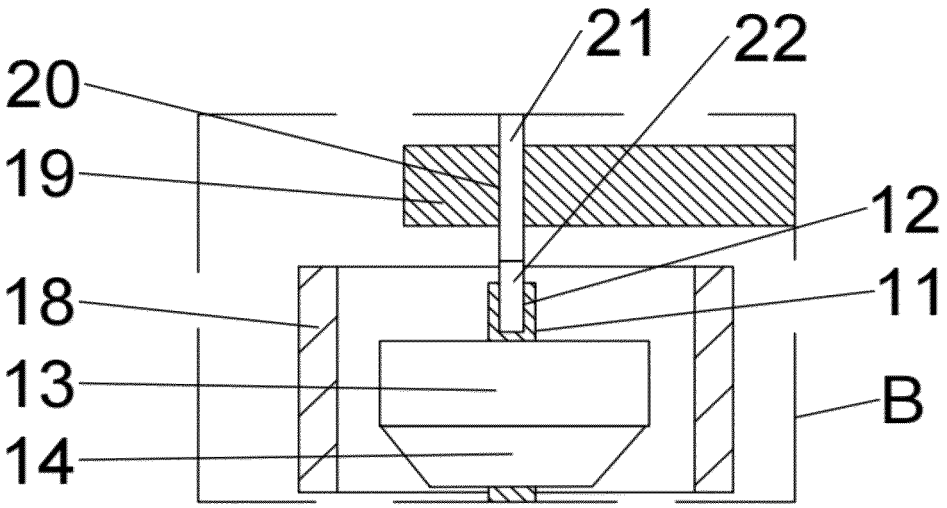
FIG. 3 is an enlarged view at B in FIG. 2 of the present invention.
Figure 4:
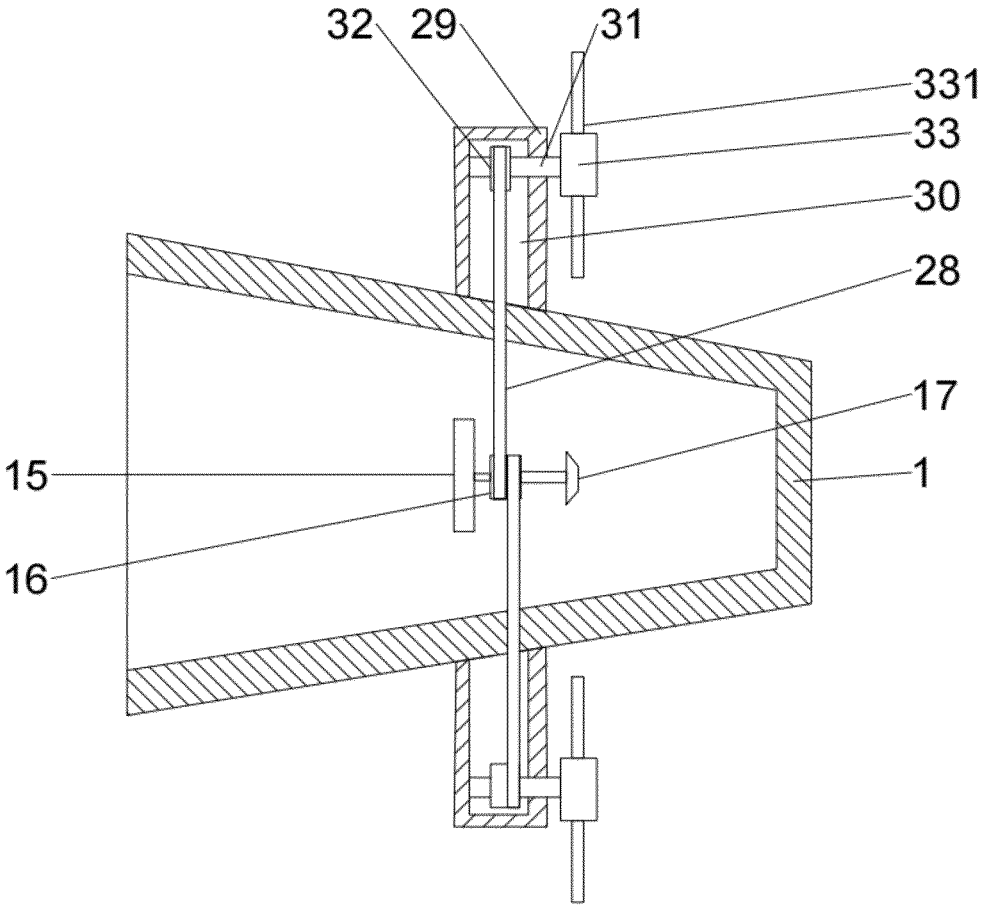
FIG. 4 is a top view of an acceleration mechanism in FIG. 1 of the present invention.
Figure 5:
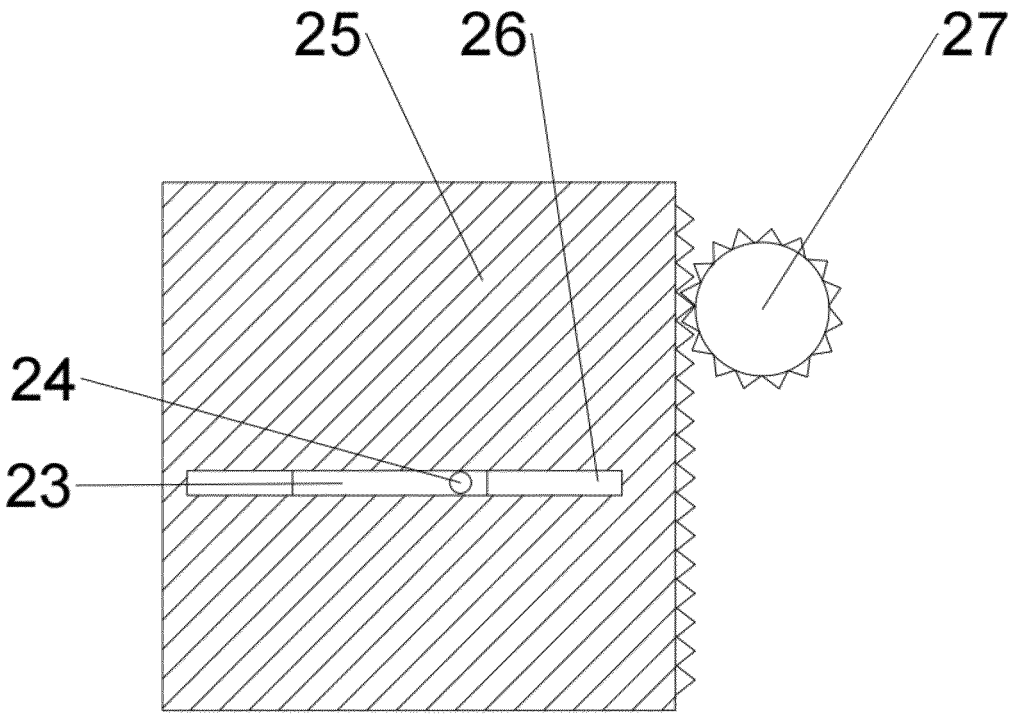
FIG. 5 is a top view of a sliding toothed plate and a first spur gear in FIG. 1 of the present invention.

As shown in FIGS. 1-5, a hybrid-power-driven underwater robot comprises a robot body 1 and a releasing and recovering device 2, wherein a first transmission cavity 34 is formed in the releasing and recovering device 2, a seawater removing mechanism and an electric take-up reel 3 are arranged inside the first transmission cavity 34, a cable 43 is arranged on the electric take-up reel 3, the cable 43 extends out of the first transmission cavity 34, and the robot body 1 is fixedly connected to one end of the cable 43; and a tail fin 4 is movably connected to the robot body 1, an acceleration mechanism is further arranged on the robot body 1, a second transmission cavity 6 is formed in the robot body 1, a driving mechanism for driving the tail fin 4 and the acceleration mechanism is arranged inside the second transmission cavity 6, and the driving mechanism can drive the tail fin 4 separately or drive the acceleration mechanism separately.

In a preferred embodiment of the present invention, the driving mechanism comprises an electromagnetic device 7, a support plate 8, a first elastic member 9, a permanent magnetic plate 10, an electric motor 11, a permanent magnetic block 13, a first bevel gear 14, a conductor coil 18, a connecting plate 19, a rotating rod 21, a first transmission strip 23, a second transmission strip 24 and a sliding toothed plate 25;

the electromagnetic device 7 is inlaid in a bottom wall of the second transmission cavity 6, the support plate 8 is connected to the bottom wall of the second transmission cavity 6 by means of the first elastic member 9, the permanent magnetic plate 10 is fixedly connected to a bottom wall of the support plate 8, the electric motor 11 is fixedly connected to a top wall of the support plate 8, the permanent magnetic block 13 and the first bevel gear 14 are fixedly connected to a power output shaft 111 of the electric motor 11, a transmission recess 12 is formed in an upper end of the power output shaft 111, the conductor coil 18 and the connecting plate 19 are fixedly connected to a rear wall of the second transmission cavity 6, the conductor coil 18 is electrically connected to the electromagnetic device 7, the permanent magnetic block 13 is located in the conductor coil 18, a through hole 20 is formed in the connecting plate 19, the rotating rod 21 penetrates through the through hole 20, the rotating rod 21 is rotatably connected to an inner wall of the through hole 20, a transmission block 22 is fixedly connected to a lower end of the rotating rod 21, the shape of the transmission recess 12 matches that of the transmission block 22, the first transmission strip 23 is perpendicularly fixedly connected to an upper end of the rotating rod 21, the second transmission strip 24 is perpendicularly fixedly connected to a top wall of the first transmission strip 23, the sliding toothed plate is slidably connected to a top wall of the second transmission cavity 6, a transmission channel 26 is formed in a bottom wall of the sliding toothed plate 25, and the second transmission strip 24 is slidably connected to an inner wall of the transmission channel 26;

the acceleration mechanism comprises a fixing plate 15, a first rotating wheel 16, a second bevel gear 17 and two propeller mechanisms, the fixing plate 15 is fixedly connected to the bottom wall of the second transmission cavity 6, the first rotating wheel 16 is rotatably connected to the fixing plate 15, and the second bevel gear 17 is fixedly connected to the first rotating wheel 16;

each of the propeller mechanisms comprises a transmission belt 28, an extension plate 29, a second rotating wheel 32, a rotating shaft 31, a hub 33 and a paddle 331, the extension plate 29 is fixedly connected to an outer wall of the robot body 1, a third transmission cavity 30 is formed in the extension plate 29, the rotating shaft 31 is rotatably connected to a side wall of the third transmission cavity 30, one end of the rotating shaft 31 extends out of the extension plate 29, the second rotating wheel 32 and the hub 33 are fixedly connected to the rotating shaft 31, the second rotating wheel 32 is connected to the first rotating wheel 16 by means of the transmission belt 28, and the paddle 331 is fixedly connected to the hub 33; and the tail fin 4 is rotatably connected to the robot body 1 by means of a U-shaped member 5, the U-shaped member 5 penetrates through the second transmission cavity 6, a first spur gear 27 is fixedly connected to the U-shaped member 5, and the sliding toothed plate 25 is engaged with the first spur gear 27.

The implementation process is as follows: at the beginning, the transmission block 22 is inserted into the transmission recess 12, when the robot body 1 needs to advance slowly in the relatively calm water, the electric motor 11 is started, and the power output shaft 111 rotates relatively slowly to drive the permanent magnetic block 13 and the first bevel gear 14 to rotate slowly; the permanent magnetic block 13 rotates relatively slowly, so that the conductor coil 18 generates a current to supply power to the electromagnetic device 7 to generate a relatively small magnetic force which is insufficient for the permanent magnetic plate 10 and the support plate 8 to overcome the first elastic member 9 to move downwards, and the transmission block 22 is stilled located in the transmission recess 12; and the power output shaft 111 drives the rotating rod 21, the first transmission strip 23 and the second transmission strip 24 to rotate, the second transmission strip 24 drives the sliding toothed plate 25 to reciprocate forwards and backwards by means of the transmission channel 26 so as to drive the first spur gear 27, the U-shaped member 5 and the tail fin 4 to swing in a reciprocating manner, the tail fin 4 swings to drive the robot body 1 to advance slowly in the water, the advancing manner of a fish can be simulated, the tail fin is suitable for slow and stable advancing of the robot body 1, and the advancing of the tail fin 4 is not likely to be hindered by debris such as sea grass and the like.

In case of an emergency, when the robot body 1 needs to advance in an accelerated manner, the power output shaft 111 of the electric motor 11 is controlled to rotate relatively quickly; the rotating speed is increased, so that the conductor coil 18 generates a current to supply power to the electromagnetic device 7 to generate a relatively large magnetic force which makes the permanent magnetic plate 10 and the support plate 8 overcome the first elastic member 9 to move downwards, and the transmission block 22 is separated from the transmission recess 12; and the first bevel gear 14 is engaged with the second bevel gear 17, the first bevel gear 14 drives the second bevel gear 17 to rotate so as to drive the first rotating wheel 16 and the transmission belts 28, the second rotating wheels 32, the rotating shafts 31, the hubs 33 and the paddles 331 of the two propeller mechanisms to rotate, the paddles 331 push the robot body 1 to advance in the accelerated manner, and the robot body 1 advances stably in the accelerated manner by means of the two paddles 331.

The appearance of the robot body 1 is designed as a fish and is in the shape of a streamline, the water flow movement from the fish head to the fish tail is stable, the hydrodynamic resistance is very low, and the hydrodynamic properties are good.

In this embodiment, switching between two kinds of power can be carried out by controlling the rotating speed of the power output shaft 111 of the electric motor 11, a tail fin 4 swinging mode is adopted at ordinary times, when acceleration is needed in case of an emergency, the power output shaft 111 can rotate in the accelerated manner to switch to an acceleration mode, that is, the two paddles 331 rotate to drive the robot body 1 to advance stably, dual-mode switching can be realized by just one power source, namely, one electric motor 11, thus the design is ingenious, and the practicability is high.

In a preferred embodiment of the present invention, the seawater removing mechanism comprises a guide roller 35, a second elastic extrusion roller 36, a first elastic extrusion roller 37, a second spur gear 38, a third spur gear 39, fan blades an electric heating net controller 41 and an electric heating net 42, the guide roller 35, the second elastic extrusion roller 36, the second spur gear 38 and the third spur gear 39 are rotatably connected to a rear wall of the first transmission cavity 34, the first elastic extrusion roller 37 is fixedly connected to the second spur gear 38, the fan blades 40 are fixedly connected to the third spur gear 39, the second spur gear 38 is engaged with the third spur gear 39, the electric heating net controller 41 is fixedly connected to the rear wall of the first transmission cavity 34, the electric heating net 42 is fixedly connected to the electric heating net controller 41, the second elastic extrusion roller 36 and the first elastic extrusion roller 37 clamp the cable 43, and the cable 43 abuts against the guide roller 35.

The implementation process is as follows: when the robot body 1 needs to be recovered, the cable 43 is recovered by means of the electric take-up reel 3, the cable 43 drives the second elastic extrusion roller 36 and the first elastic extrusion roller 37 to rotate, the second elastic extrusion roller 36 and the first elastic extrusion roller 37 extrude the cable 43 to squeeze out the moisture of the cable 43, meanwhile, the first elastic extrusion roller 37 drives the second spur gear 38, the third spur gear 39 and the fan blades 40 to rotate, the electric heating net controller 41 controls the electric heating net 42 to generate heat, the fan blades rotate to generate wind, the wind is blown to the electric heating net 42 to become hot wind, the cable 43 is dried by the hot wind, and the cable 43 in a wet state is prevented from entering the electric take-up reel 3, so that the cable 43 and the interior of the electric take-up reel 3 are prevented from being corroded by the seawater.

In this embodiment, the moisture of the cable 43 is squeezed by means of the second elastic extrusion roller 36 and the first elastic extrusion roller 37, and meanwhile, the fan blades 40 rotate to blow out the hot wind to further remove the seawater for the cable 43.

In a preferred embodiment of the present invention, the cable 43 is made of a colored material. A user can observe the approximate position and direction of the robot body 1 conveniently.

In a preferred embodiment of the present invention, the first elastic extrusion roller 37 and the second elastic extrusion roller 36 are made of silica gel materials.

In a preferred embodiment of the present invention, the first elastic extrusion roller 37 and the second elastic extrusion roller 36 are made of sponge materials.

In a preferred embodiment of the present invention, a flow drainage plate 44 is fixedly connected to a bottom wall of the first transmission cavity 34, and a top wall of the flow drainage plate 44 is in the shape of an inclined plane. The squeezed seawater can conveniently flow out of the releasing and recovering device 2 along the top wall, in the shape of the inclined plane, of the flow drainage plate 44.

In a preferred embodiment of the present invention, the flow drainage plate 44 is made of a stainless steel material.

Components, modules, mechanisms, devices and the like of the structures that are not described in detail in the present invention are all common standard components or components known by those skilled in the art, and the structures and the principles thereof can be obtained by those skilled in the art by means of technical manuals or conventional experimental methods.

Finally, it should be noted that the above-mentioned embodiments are only used to illustrate the technical solutions of the present invention, not to limit the scope of protection of the present invention; although the present invention is described in detail with reference to the preferred embodiments, those of ordinary skill in the art should understand that they can amend or perform equivalent substitutions on the technical solutions of the present invention without departing from the essence and the scope of the technical solutions of the present invention.

The invention claimed is:

1. A hybrid-power-driven underwater robot, comprising a robot body (1) and a releasing and recovering device (2), wherein a first transmission cavity (34) is formed in the releasing and recovering device (2), a seawater removing mechanism and an electric take-up reel (3) are arranged inside the first transmission cavity (34), a cable (43) is arranged on the electric take-up reel (3), the cable (43) extends out of the first transmission cavity (34), and the robot body (1) is fixedly connected to one end of the cable (43); and a tail fin (4) is movably connected to the robot body (1), an acceleration mechanism is further arranged on the robot body (1), a second transmission cavity (6) is formed in the robot body (1), a driving mechanism for driving the tail fin (4) and the acceleration mechanism is arranged inside the second transmission cavity (6), and the driving mechanism can drive the tail fin (4) separately or drive the acceleration mechanism separately.

2. The robot according to claim 1, wherein the driving mechanism comprises an electromagnetic device (7), a support plate (8), a first elastic member (9), a permanent magnetic plate (10), an electric motor (11), a permanent magnetic block (13), a first bevel gear (14), a conductor coil (18), a connecting plate (19), a rotating rod (21), a first transmission strip (23), a second transmission strip (24) and a sliding toothed plate (25);

the electromagnetic device (7) is inlaid in a bottom wall of the second transmission cavity (6), the support plate (8) is connected to the bottom wall of the second transmission cavity (6) by means of the first elastic member (9), the permanent magnetic plate (10) is fixedly connected to a bottom wall of the support plate (8), the electric motor (11) is fixedly connected to a top wall of the support plate (8), the permanent magnetic block (13) and the first bevel gear (14) are fixedly connected to a power output shaft (111) of the electric motor (11), a transmission recess (12) is formed in an upper end of the power output shaft (111), the conductor coil (18) and the connecting plate (19) are fixedly connected to a rear wall of the second transmission cavity (6), the conductor coil (18) is electrically connected to the electromagnetic device (7), the permanent magnetic block (13) is located in the conductor coil (18), a through hole (20) is formed in the connecting plate (19), the rotating rod (21) penetrates through the through hole (20), the rotating rod (21) is rotatably connected to an inner wall of the through hole (20), a transmission block (22) is fixedly connected to a lower end of the rotating rod (21), the transmission block (22) is in the shape of a prism, the shape of the transmission recess (12) matches that of the transmission block (22), the first transmission strip (23) is perpendicularly fixedly connected to an upper end of the rotating rod (21), the second transmission strip (24) is perpendicularly fixedly connected to a top wall of the first transmission strip (23), the sliding toothed plate (25) is slidably connected to a top wall of the second transmission cavity (6), a transmission channel (26) is formed in a bottom wall of the sliding toothed plate (25), and the second transmission strip (24) is slidably connected to an inner wall of the transmission channel (26);

the acceleration mechanism comprises a fixing plate (15), a first rotating wheel (16), a second bevel gear (17) and two propeller mechanisms, the fixing plate (15) is fixedly connected to the bottom wall of the second transmission cavity (6), the first rotating wheel (16) is rotatably connected to the fixing plate (15), and the second bevel gear (17) is fixedly connected to the first rotating wheel (16);

each of the propeller mechanisms comprises a transmission belt (28), an extension plate (29), a second rotating wheel (32), a rotating shaft (31), a hub (33) and a paddle (331), the extension plate (29) is fixedly connected to an outer wall of the robot body (1), a third transmission cavity (30) is formed in the extension plate (29), the rotating shaft (31) is rotatably connected to a side wall of the third transmission cavity (30), one end of the rotating shaft (31) extends out of the extension plate (29), the second rotating wheel (32) and the hub (33) are fixedly connected to the rotating shaft (31), the second rotating wheel (32) is connected to the first rotating wheel (16) by means of the transmission belt (28), and the paddle (331) is fixedly connected to the hub (33); and the tail fin (4) is rotatably connected to the robot body (1) by means of a U-shaped member (5), the U-shaped member (5) penetrates through the second transmission cavity (6), a first spur gear (27) is fixedly connected to the U-shaped member (5), and the sliding toothed plate (25) is engaged with the first spur gear (27).

3. The robot according to claim 1, wherein the seawater removing mechanism comprises a guide roller (35), a second elastic extrusion roller (36), a first elastic extrusion roller (37), a second spur gear (38), a third spur gear (39), fan blades (40), an electric heating net controller (41) and an electric heating net (42), the guide roller (35), the second elastic extrusion roller (36), the second spur gear (38) and the third spur gear (39) are rotatably connected to a rear wall of the first transmission cavity (34), the first elastic extrusion roller (37) is fixedly connected to the second spur gear (38), the fan blades (40) are fixedly connected to the third spur gear (39), the second spur gear (38) is engaged with the third spur gear (39), the electric heating net controller (41) is fixedly connected to the rear wall of the first transmission cavity (34), the electric heating net (42) is fixedly connected to the electric heating net controller (41), the second elastic extrusion roller (36) and the first elastic extrusion roller (37) clamp the cable (43), and the cable (43) abuts against the guide roller (35).

4. The robot according to claim 3, wherein the cable (43) is made of a colored material.

5. The robot according to claim 3, wherein the first elastic extrusion roller (37) and the second elastic extrusion roller (36) are made of silica gel materials.

6. The robot according to claim 3, wherein the first elastic extrusion roller (37) and the second elastic extrusion roller (36) are made of sponge materials.

7. The robot according to claim 3, wherein a flow drainage plate (44) is fixedly connected to a bottom wall of the first transmission cavity (34), and a top wall of the flow drainage plate (44) is in the shape of an inclined plane.

8. The robot according to claim 7, wherein the flow drainage plate (44) is made of a stainless steel material.

* * * * *